United States Patent [19]

Kelso

[11] Patent Number: 4,835,893

[45] Date of Patent: Jun. 6, 1989

[54] FIREARM WITH REMOVABLE TRIGGER

[76] Inventor: John H. Kelso, P.O. Box 1175, Fort Myers, Fla. 33902

[21] Appl. No.: 163,775

[22] Filed: Mar. 3, 1988

[51] Int. Cl.[4] ..... F41C 19/00

[52] U.S. Cl. ..... 42/69.01; 42/DIG. 1

[58] Field of Search ..... 42/69.01, 70.01, DIG. 1

[56] References Cited

U.S. PATENT DOCUMENTS

| | | |
|---|---|---|
| 1,079,855 | 11/1913 | Guarino . |
| 2,027,950 | 1/1936 | Young . |
| 2,448,810 | 9/1948 | Koucky et al. . |
| 2,557,415 | 6/1951 | Dayton . |
| 3,984,934 | 10/1976 | Weiss . |
| 4,499,683 | 2/1985 | Sanoli . |
| 4,667,429 | 5/1987 | Perazzi . |

*Primary Examiner*—Charles T. Jordan
*Assistant Examiner*—Richard W. Wendtland
*Attorney, Agent, or Firm*—Fleit, Jacobson, Cohn & Price

[57] ABSTRACT

A firearm is provided customarily equipped with a shiftable trigger body portion mounted from the frame of the firearm for movement between a firing position and a release position and incorporating an outwardly projecting arcuate tang portion engageable by a user's trigger finger and enclosed within a trigger guard. The instant invention resides in the removable mounting of the finger engageable tang portion from the body portion of the trigger and, further, the construction of the finger engageable portion as a continuous peripheral ring shaped member which may be conveniently retained on a user's trigger finger during periods of non-use of the associated handgun. In a first disclosed form of the invention the ring-type trigger finger engageable portion is removably secured to the body portion of the trigger through the utilization of threaded shank-type fasteners and in a second disclosed form of the invention the ring-shaped finger engageable portion merely includes an outwardly projecting shank telescopingly receivable within an outwardly opening recess formed in the body portion of the trigger. The removability of the finger engageable portion substantially eliminates accidental firing of the handgun.

7 Claims, 1 Drawing Sheet

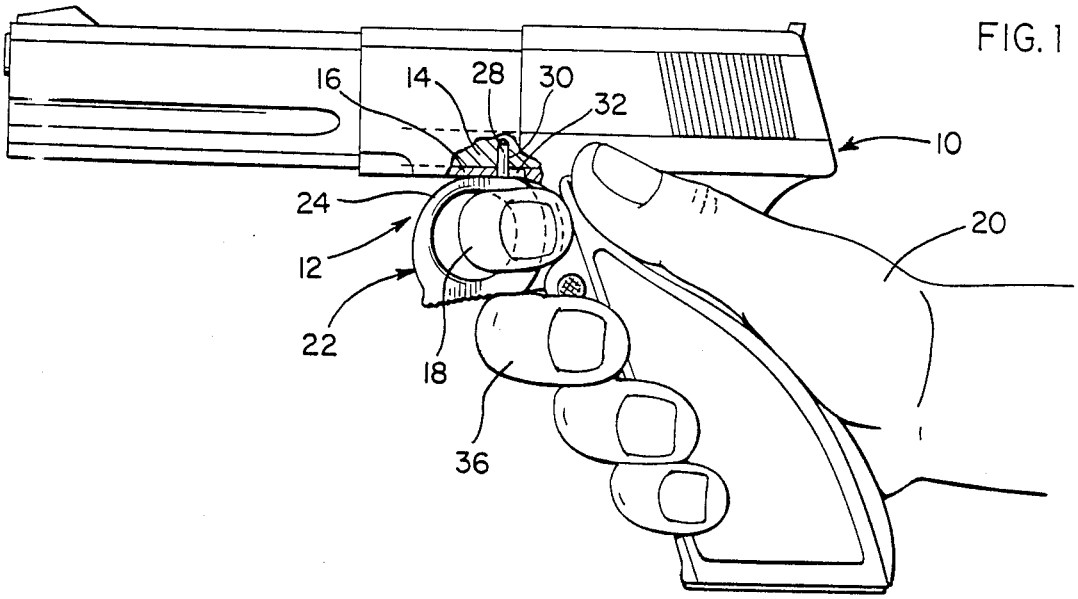
FIG. 1
FIG. 3
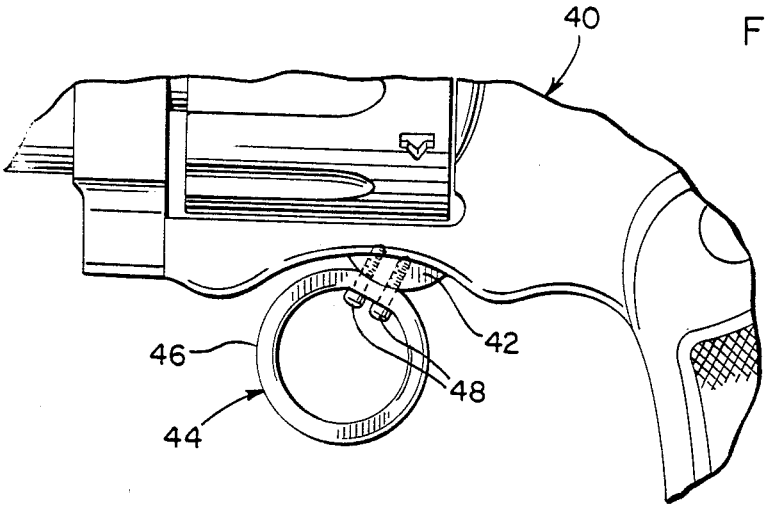
FIG. 2
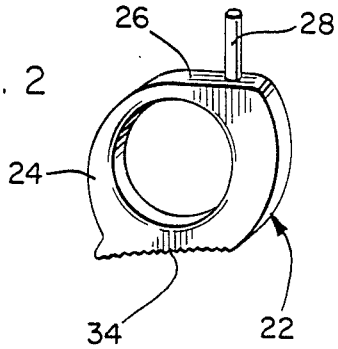
FIG. 4
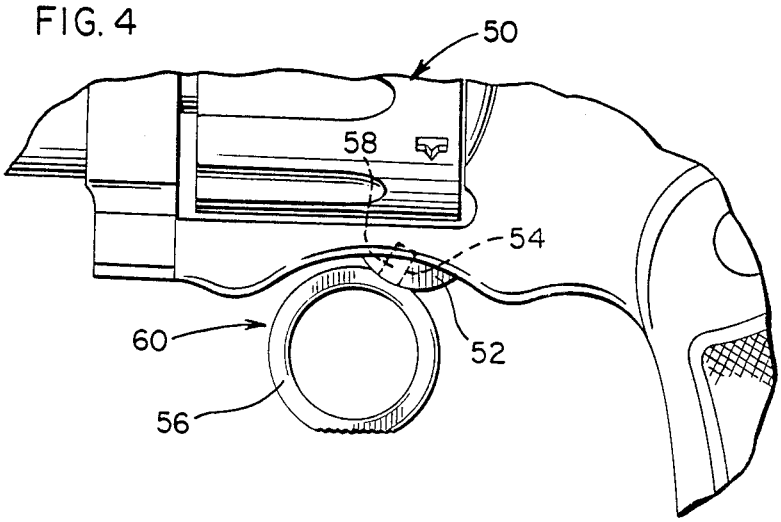
FIG. 5
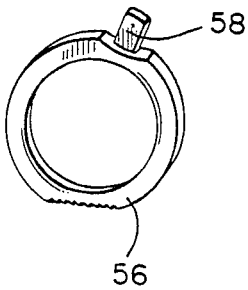

FIREARM WITH REMOVABLE TRIGGER

BACKGROUND OF THE INVENTION

Field of the Invention

The body portion of the trigger assembly of a firearm usually is shiftably mounted from a frame portion of the firearm for movement between a firing position and a release position and a unitary finger engageable portion projects outward from the body portion and adjacent frame component of the firearm. The finger engageable portion of the instant invention is removably supported from the body potion of the trigger assembly.

In a first disclosed form of the invention the finger engageable portion comprises a ring including a substantially radially outwardly projecting shank portion telescopingly receivable within a corresponding outwardly opening recess formed in the trigger assembly body portion, thereby enabling the finger engageable portion to be readily removed from engagement with the body portion of the trigger assembly to greatly reduce the chances of accidental firing of the associated firearm.

In a second disclosed form of the invention the finger engageable portion of the trigger assembly is mounted from the body portion of the trigger assembly through the utilization of removable threaded shank-type fasteners.

The finger engageable portion of the trigger assembly may be in the form of a peripherally closed ring, or may assume the arcuate tang-shape of the exposed portion of a conventional handgun or long gun trigger. However, by utilizing a peripherally enclosed ring ready removable engagement of the finger engageable portion of the trigger assembly with the associated body portion may be readily effected and maintained.

DESCRIPTION OF RELATED ART

Various different forms of removable trigger assemblies including some of the general structural and operational features of the instant invention heretofore have been known. Examples of these previously known forms of trigger assemblies are disclosed in U.S. Pat. Nos. 1,079,855, 2,448,810, 2,557,415, 3,984,934, 4,499,683 and 4,667,429.

However, these previously patented forms of removable trigger assemblies and other similar structures do not include the overall combination of structural and operational features of the instant invention.

SUMMARY OF THE INVENTION

The detachable firearm trigger of the instant invention has been specifically designed to substantially eliminate the possibility of accidental discharging of a firearm in a non-preparatory-to-fire situation. The detachable trigger is designed to be detached from the remainder of an associated firearm at any time a firearm is not being handled immediately preparatory to use thereof.

The main object of this invention is to provide a removable trigger for a firearm and constructed in a manner whereby the trigger may be manually supported against accidental loss thereof when usage of an associated firearm also being carried is not contemplated.

Another object of this invention, in accordance with the immediately preceding object, is to provide a firearm having a removable trigger and yet constructed in a manner such that the removable portion of the trigger may be readily operatively engaged with a non-removable portion of the trigger immediately prior to intended usage of the associated firearm.

Still another object of this invention is to provide a removable trigger for a firearm which may be semi-permanently mounted upon the firearm.

A final object of this invention to be specifically enumerated herein is to provide a removable trigger which will conform to conventional forms of manufacture, be of simple construction and easy to use so as to provide a device that will be economically feasible, long-lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a side elevational view of a conventional form of "automatic" handgun illustrating a removable trigger operatively associated therewtih, portions of the firearm being broken away and illustrated in vertical section.

FIG. 2 is an enlarged perspective view of the removable trigger illustrated in FIG. 1.

FIG. 3 is a fragmentary side elevational view of a "revolver" equipped with a removable trigger constructed in accordance with the present invention and wherein a pair of removable, threaded shank-type fasteners are used to secure the finger engageable portion of the trigger to the revolver mounted body portion of the trigger.

FIG. 4 is a fragmentary side elevational view of a "revolver" illustrating a third form of removable trigger incorporating a generally radially outwardly projecting shank telescopingly receivable in a corresponding recess formed in the revolver frame mounted body portion of the trigger.

FIG. 5 is a perspective view of the removable trigger illustrated in FIG. 4.

DESCRIPTION OF THE PREFERRED EMBODIMENTS

Referring now more specifically to the drawings, the numeral 10 generally designates a conventional form of "automatic" handgun. The handgun 10 includes a trigger assembly referred to in general by the reference numeral 12 and including a body portion 14 shiftably supported relative to a frame portion 16 of the handgun 10 for movement between a rearward firing position and a forward release position, the body portion 14 being yieldingly biased toward the forward release position.

Conventionally, the body portion 14 includes a depending forwardly curving finger engageable tang portion (not shown) for engagement by the index finger of the hand 20 of a user of the handgun 10. However, the instant invention incorporates a removable finger engageable portion referred to in general by the reference numeral 22. The portion 22 is in the form of a continuous periphery ring member 24 from one flattened peripheral side 26 of which a small diameter cylindrical shank 28 projects. The body portion 14 includes a small diameter downwardly opening bore 30 formed therein registered with a front-to-rear extending slot 32 formed in the frame portion 16.

The finger engageable portion 22 comprising the ring member 24 may be "worn" on the index finger 18 of the hand 20 until immediately before intended usage of the handgun 10. Then, with the ring member 24 being worn on the index finger 18, the shank 28 may be upwardly inserted though the slot 32 and telescoped into the bore 30. This of course operationally connects the ring member 24 to the body portion 14 such that the index finger 18 may be used to exert a rearward pull on the body portion 14 through the ring member 24 in order to shift the body portion 14 rearward to the firing position. The side 34 of the ring member 24 remote from the side 26 outwardly from which the shank 28 projects is slightly concavely arcuate and faces in a downward direction for guided sliding movement over the second finger 36 of the hand 20.

Of course, when the finger engageable portion 22 is removed from engagement with the body portion 14, accidental firing of the handgun 10 is substantially prevented.

With attention now invited more specifically to FIG. 3 of the drawings, there may seen a second "revolver" handgun referred to in general by the reference numeral 40 and including an oscillatably supported trigger body portion 42 corresponding to the body portion 14 of the handgun 10. A finger engageable portion 44 corresponding to the finger engageable portion 22 and also in the form of a continuous periphery ring member 46 is provided and a pair of elongated, threaded, shank-type fasteners 48 are secured through parallel bores formed generally radially through one peripheral portion of the ring member 46 and threaded into corresponding threaded blind bores formed in the body portion 14 to thereby removably support the ring member 46 from the body member 42.

When that form of the invention illustrated in FIG. 3 is used, it will be used primarily to prevent accidental discharge of the firearm 40 during extended periods of storage or non-use.

If it is desired, that form of finger engageable portion 44 illustrated in FIG. 3 also may be used in conjunction with a firearm such as the firearm 40 including a trigger guard. However, the necessity of telescopic engagement of the shank 28 in the bore 30 with regard to the trigger assembly 12 illustrated in FIG. 1 substantially prevents the trigger assembly 12 from being utilized in conjunction with an automatic having a conventional trigger guard.

With attention now invited more specifically to FIGS. 4 and 5 of the drawings, a third handgun is illustrated in FIG. 4 and referred to in general by the reference numeral 50. The handgun 50 is in the form of a "revolver" and includes a trigger assembly body portion 52 corresponding to the trigger assembly body portion 42 illustrated in FIG. 3.

However, rather than being provided with a pair of threaded blind bores such as that provided on the body portion 42, the body portion 52 includes an outwardly opening blind recess 54 formed therein which is generally rectangular in cross sectional shape and a finger engageable portion referred to in generally radially outwardly projecting shank 58 which is also rectangular in transverse cross section and telescopingly receivable within the recess 54. The rectangular cross section of the shank 58 and the corresponding cross sectional shape of the recess 54 enable the finger engageable portion 56 to be "keyed" to the body portion 52 against angular displacement relative thereto about an axis extending longitudinally of the shank 58, thus more positively stabilizing the finger engageable portion 56 relative to the body portion 52. Of course, the operation of the trigger assembly referred to in general by the reference numeral 60 and incorporating the portions 56 and 58 is substantially the same as the trigger assembly 12. Furthermore, the finger engaging portion 22 may be provided with a shank which is rectangular in cross section and the bore 30 may be in the form of a recess such as the recess 54 which is also rectangular in transverse cross section.

It further is pointed out that the finger engageable portion 56 need not be a peripherally continuous ring member. Rather, the entire portion of the finger engageable portion 56 to the left of a vertical plane passing centrally through the finger engageable portion 56 as illustrated in FIG. 4 may be omitted, if desired. However, such a modified finger engageable portion 56 would not be capable of being supported for ready use upon the index finger 18 of the hand 20. Therefore, it is more likely that a semi-permanently installed finger engageable portion such as the finger engageable portion 44 would have the entire left hand side thereof omitted.

The foregoing is considered as illustrative only of the principles of the invention. Further since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. In combination with a firearm of the type including a frame and a trigger assembly incorporating a body portion shiftably supported from the frame for movement between a firing position and a release position and yieldingly biased toward said release position, said trigger assembly also incorporating a finger engageable portion projecting outwardly from said body portion and a marginal portion of said frame for engagement by a "trigger finger" of a user of the firearm, said body portion and finger engageable portion including coacting means removably connecting said finger engageable portion to said body portion, said finger engageable portion defining a finger receiving opening formed therethrough adapted to receive an index finger therein, said opening including an unbroken periphery.

2. The firearm frame and trigger assembly of claim 1 wherein said shank projects outwardly from a first side of said finger engaging portion, a second side of said finger engaging portion remote from said first side including a slightly concave arcuate guide surface opening outwardly therefrom.

3. The firearm frame and trigger assembly of claim 1 wherein said coacting means includes removable fastener means removably securing said finger engageable portion to said body portion.

4. The firearm frame and trigger assembly of claim 1 wherein said coacting means include an outwardly opening recess formed in said body portion and an elongated shank carried by said finger engageable portion removably telescopically received in said recess.

5. The firearm frame and trigger assembly of claim 4 wherein said recess and shank are circular in cross sectional shape.

6. The firearm frame and trigger assembly of claim 4 wherein said recess and shank are generally rectangular in cross section and thus key said shank to said body portion against angular displacement relative thereto about an axis extending longitudinally of said shank.

7. In combination with a firearm of the type including a frame and a trigger assembly incorporating a body portion shiftably supported from the frame for movement between a firing position and a release position and yieldingly biased toward said release position, said trigger assembly also incorporating a finger engageable portion projecting outwardly from said body portion as well as a marginal portion of said frame for engagement by a "trigger finger" of a user of the firearm, said body portion and finger engageable portion including coacting means removably connecting said finger engageable portion to said body portion, said ring member defining a finger receiving opening therethrough adapted to receive a hand finger therein, whereby said ring member may be slipped longitduinally along and onto and off a hand finger, said ring member including a predetermined outer peripheral side, said coacting means mounting said ring member from said body portion with said body portion and outer peripheral side in close juxtaposition.

* * * * *